US008329041B2

(12) United States Patent
Joensen

(10) Patent No.: US 8,329,041 B2
(45) Date of Patent: Dec. 11, 2012

(54) SHIP WITH A CONTAMINANT SEPARATION DEVICE

(75) Inventor: Kaj Joensen, Vágur Islands (FO)

(73) Assignee: P/F Faroe Maritime Technic, Vagur Islands (FO)

( * ) Notice: Subject to any disclaimer, the term of this patent is extended or adjusted under 35 U.S.C. 154(b) by 471 days.

(21) Appl. No.: 12/733,360

(22) PCT Filed: Aug. 28, 2008

(86) PCT No.: PCT/DK2008/000307

§ 371 (c)(1),
(2), (4) Date: Feb. 25, 2010

(87) PCT Pub. No.: WO2009/026924

PCT Pub. Date: Mar. 5, 2009

(65) Prior Publication Data

US 2010/0213132 A1 Aug. 26, 2010

(30) Foreign Application Priority Data

Aug. 29, 2007 (DK) ..... 2007 01226
Apr. 3, 2008 (DK) ..... 2008 00486

(51) Int. Cl.
*C02F 1/00* (2006.01)

(52) U.S. Cl. ..... 210/739; 210/783; 210/800; 210/805; 210/242.3; 210/242.4; 210/138; 210/103; 210/197; 210/532.1

(58) Field of Classification Search ..... 210/739, 210/783, 800, 805, 242.3, 242.4, 138, 103, 210/197, 532.1
See application file for complete search history.

(56) References Cited

U.S. PATENT DOCUMENTS

| | | | | |
|---|---|---|---|---|
| 3,617,552 | A * | 11/1971 | Will et al. | 210/649 |
| 3,917,945 | A | 11/1975 | Sema et al. | |
| 3,992,292 | A * | 11/1976 | Grimes et al. | 210/671 |
| 5,259,958 | A * | 11/1993 | Bronnec et al. | 210/526 |
| 6,521,125 | B1 | 2/2003 | Schillereff | |
| 6,525,325 | B1 | 2/2003 | Andrews et al. | |

FOREIGN PATENT DOCUMENTS

| | | | |
|---|---|---|---|
| GB | 1 210 967 | | 11/1970 |
| GB | 1 530 690 | | 11/1978 |
| GB | 1 531 687 | | 11/1978 |
| GB | 2 027 604 | A | 2/1980 |
| GB | 2 124 922 | A | 2/1984 |
| GB | 2 357 045 | A | 6/2001 |
| JP | 61-71885 | A | 4/1986 |
| JP | 2007-111688 | A | 5/2007 |
| JP | 2007-125507 | A | 5/2007 |
| WO | 94/27700 | A1 | 12/1994 |
| WO | 01/43893 | A2 | 6/2001 |

* cited by examiner

*Primary Examiner* — Chester Barry
(74) *Attorney, Agent, or Firm* — Nath, Goldberg & Meyer; Jerald L. Meyer; Stanley N. Protigal

(57) ABSTRACT

A ship comprises a bilge water sump collecting bilge water and contaminants. A first contaminant separation device is provided comprising a conveyor arrangement with an endless belt comprising adsorbing/absorbing material. The conveyor arrangement has a first portion submergible into the bilge water and contaminants in the bilge water sump, and a second portion being spaced from the first portion and provided with means for releasing adsorbed/absorbed contaminants from the conveyor belt and means for collecting the contaminants released. The conveyor arrangement is further provided with means for driving the endless belt along a moving path defined by guiding means.

25 Claims, 5 Drawing Sheets

SHIP WITH A CONTAMINANT SEPARATION DEVICE

Figure 1:
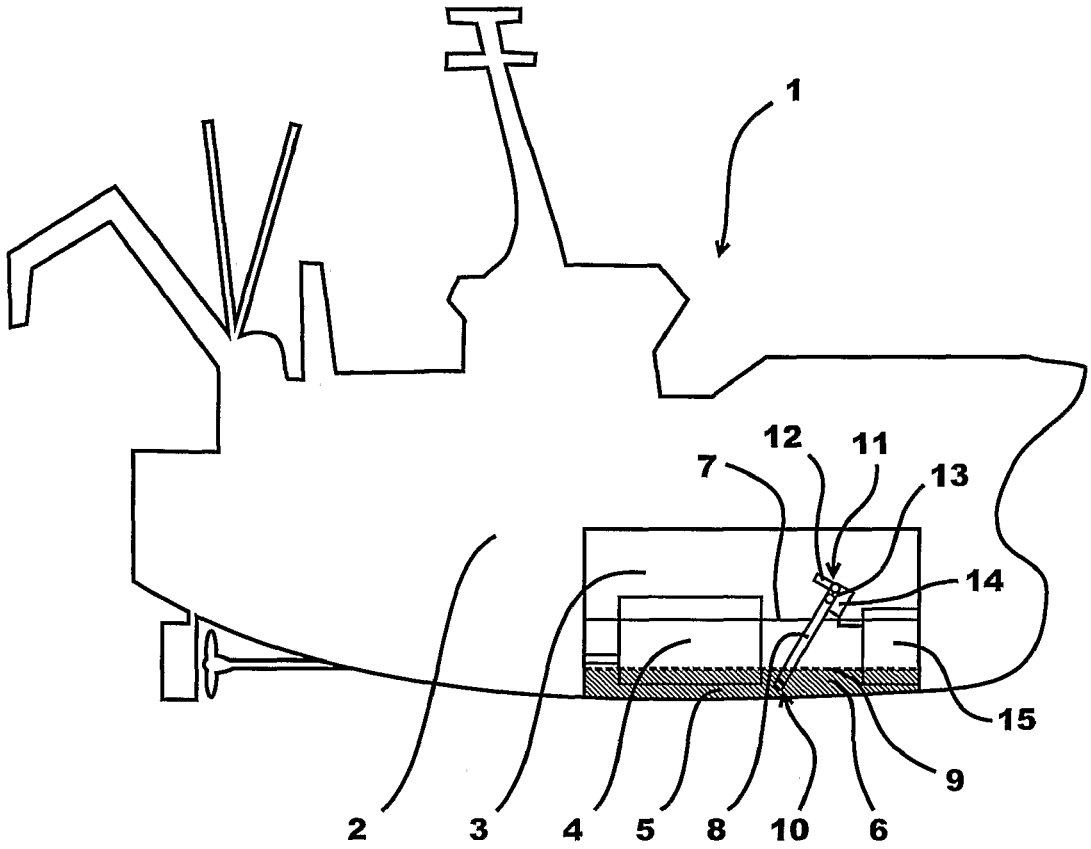

This is a National Phase Application filed under 35 USC 371 of International Application No. PCT/DK2008/000307, filed on Aug. 28, 2008, an application claiming foreign priority benefits under 35 USC 119 of Danish Application No. PA 2007 01226, filed on Aug. 29, 2007, and claiming foreign priority benefits under 35 USC 119 of Danish Application No. PA 2008 00486, filed on Apr. 3, 2008, the content of each of which is hereby incorporated herein by reference in its entirety.

TECHNICAL FIELD

The invention relates to a ship comprising a bilge water sump for collecting bilge water and contaminants, said bilge water sump optionally being covered by one or more floor panels.

BACKGROUND

Inside a ship, waste water from cleaning and/or from small leakages in the hull of the ship accumulates—typically at the bottom of the hull or in a sump provided for that purpose. Particularly in the engine room of the ship, waste water accumulates together with all kinds of contaminants in the bilge water sump. The predominant contaminants in the bilge water are fluid organic compounds, such as oil, grease, solvents, and/or fuel. Other contaminants may be solids, such as filings or swarf, or larger items, such as cans, lids, dropped tools, pieces of wood, paper, and/or textiles.

The above-mentioned fluid organic contaminants are hazardous to the health of staff working in a machinery space, since at least some of the contaminants may evaporate, creating carcinogenic vapours in the air of the machinery space. Furthermore, the contaminants are inflammable and have a tendency to concentrate at the surface of the bilge water, thereby causing a constant fire hazard. In case of fire, the contaminants develop hazardous gases and heavy smoke preventing any effective fire fighting with the additional danger of asphyxiation for those caught in the smoke. Such an accident is particularly serious when happening on a ship at sea, far from any harbour and easy rescue. In addition, the contaminants are potentially dangerous for the environment, as they pollute the sea, coasts, and harbours, when discharged directly into the sea.

The above-mentioned hazards arising from contaminated bilge water has been a problem well-known to generations of seamen and was and is often solved by pumping the bilge water directly out into the sea. However, international environmental regulations, such as the "International Convention for the Prevention of Pollution from Ships" (MARPOL 73/78), strictly regulate such discharge, among other things prohibiting any discharge of water containing more than 15 ppm oily contaminants and any discharge of oily contaminants at all within 50 miles of the nearest land.

In order to comply with these regulations, a number of oily water separators have therefore been proposed and are available on the market. However, the proposed systems are often very expensive, suffer from complexity, limited capacity at peak load, and/or lack of reliability, and have to be put out of operation frequently either for maintenance or due to system failure. As a consequence, the chosen solution is often still to simply discharge the contaminated bilge water directly into the sea disregarding all environmental regulations and the risk of serious punishment imposed on such illegal discharge by many countries.

DISCLOSURE OF THE INVENTION

The object of the present invention is to provide a reliable system for cleaning contaminated bilge water accumulating inside the hull of a ship in the engine room by separating the fluid contaminants from the bilge water, and to overcome the above mentioned shortcomings.

This is achieved by a ship of the above-mentioned type in accordance with the invention further comprising a first contaminant separation device comprising a conveyor arrangement with an endless belt, the endless belt comprising an adsorbing/absorbing material, said conveyor arrangement comprising a first portion submergible into the bilge water and contaminants in the bilge water sump and a second portion being spaced from the first portion and being provided with releasing means for releasing adsorbed/absorbed contaminants from the endless belt and collecting means for collecting the contaminants released, wherein the conveyor arrangement is further provided with driving means for driving the endless belt along a moving path defined by guiding means.

When a portion of the endless belt is submerged into the contaminated bilge water, the adsorbing/absorbing material of the endless belt mostly adsorbs/absorbs contaminants, as water tends to be released and drip off rapidly while the contaminants stick to the adsorbing/absorbing materials. The submerged portion of the endless belt is moved out of the bilge water and transferred to the releasing means of the conveyor arrangement by driving the endless belt along the moving path. On the way from the bilge water to the releasing means, the water taken up by the adsorbing/absorbing material drips off the endless belt. In practice, the water typically drips back into the bilge water sump.

Driving means, such as an electric motor connected to a drive pulley or drive roll via a gear, are provided for driving the endless belt. The moving path can have any arbitrary shape defined by the guiding means. Examples of guiding means are one or more guide rolls/pulleys, transverse bars, tubes, and/or rails.

The moving path may for example have two semicircular sections and straight sections connecting the ends of the semicircular sections with each other, as defined by two rolls arranged with a mutual interspace. In an alternative case, only one roll is provided and the moving path is defined by the circular periphery of the roll bearing the endless belt on the outside. Other shapes, such as a moving path comprising a zigzag section, may for example be defined by a plurality of deflection guide rolls and provide alternating submerged sections and non-submerged sections, wherein the non-submerged sections may be provided with releasing means and collecting means.

When in operation, the first contamination separation device takes up contaminants and water from the bilge water sump and typically produces a mixture of contaminants and water at the collection means at a total production rate. The total production rate may be expressed as a sum of partial production rates, namely a contaminant production rate and a water production rate.

In one embodiment of the invention the adsorbing/absorbing material mostly adsorbs/absorbs contaminants rather than water.

Thereby it is achieved, that the first contamination separation device mostly takes up contaminants from the bilge water sump rather than water. As a consequence, the water production rate for the production of water at the collecting means is a maximum when the first contamination device acts on clean bilge water. With an increasing amount of contaminants present in the bilge water sump, the water production rate decreases, while the contaminant production rate for the production of contaminants at the collecting means increases typically overcompensating for the decrease of water production leading to an overall increase of the total production rate.

Accordingly, with an increasing amount of contaminants present in the bilge water sump, the contaminant production rate increases to a maximum contamination production rate that is characteristic for a given system depending essentially on the design characteristics and the operation parameters of the contamination separation device. For a conveyor belt arrangement, these are for example the choice of belt material, the size and the speed of the conveyor belt.

In a further embodiment according to the invention, a ship further comprises a gravitational separation device with a settling compartment having an input port, a contaminant extraction port being arranged in a top part of the settling compartment, and a drain port arranged in a bottom part of the settling compartment, wherein the input port is connected to the output port of the collecting means, the contaminant extraction port is connected to a contaminant receptacle, and the drain port is connected with the bilge water sump by means of a return line in which a drain valve is arranged.

The total amount of contaminants and water produced at the collection means is transferred from the output port of the collecting means to the settling compartment of a gravitational separation device, preferably through a hose or pipeline. The transfer may be aided by pumping means, such as a hose pump. Thereby, the settling compartment is slowly filled with the mixture of contaminants and water. During the filling of the settling compartment, the mixture settles according to the differences in the specific weight, where the contaminants accumulate in a top part of the produced volume of the mixture and water accumulates in a bottom part.

The concentrated contaminants accumulating at the top are extracted from the settling compartment through the contamination extraction port, which is typically an overflow yielding into troughs and/or pipelines eventually leading the concentrated contaminants to a contaminant receptacle for storage and later discharge at a contaminant discharge facility.

In order to prevent the water accumulating at the bottom from reaching the contaminant extraction port, water may be drained through the drain valve arranged at the bottom of the settling compartment and returned to the bilge water sump through the return line.

The advantage of this arrangement is that the water content of the contaminant waste to be stored on the ship is reduced considerably, thereby reducing the total amount of contaminant waste collected on the ship, and thus cost for discharge of the contaminant waste in a harbour.

In a further embodiment of a ship according to the invention, the drain valve is by means of a valve actuator controllable in response to a signal, preferably an electrical signal, applied to the valve actuator.

Thereby it is achieved that the drain valve may be operated in an automatic manner, controlled by the signal. The signal may be provided from a control unit.

In a further development of the above mentioned embodiment the signal applied to the valve actuator is a timer controlled signal.

Surprisingly, a timer control of the draining step in the arrangement according to the invention has proven to work extremely well in practice—both in terms of reliability and in terms of reproducibility. Timer control ensures stable operation without the need of frequent servicing of delicate sensors, since the timer control does not require physical contact with or optical access to the mixture of contaminants and water in the gravitational separation device.]

In a preferred embodiment of a ship according to the invention, opening and closing of the drain valve is controlled by a predetermined timing sequence for alternately keeping the drain valve closed during a close time and open during an open time.

Even though a person skilled in the art may conceive numerous timing sequence programs, surprisingly it has turned out in practice that a simple sequence with a fixed open time and a fixed close time works well for most situations occurring under routine operation. Therefore, both time settings may be determined with a simple calibration routine and programmed during an installation procedure. After the installation procedure, the open and close time settings do not require further attention during routine operation.

When choosing the values for the close time and the open time, priority is given to concentrating the contaminant waste in order to reduce the water content of the contaminant waste as much as possible, thereby reducing the amount of waste to be stored on the ship and the cost for eventually discharging the waste at an appropriate discharge facility.

In practice, the close time is typically set to the time required for filling the settling compartment with water up to the contaminant extraction port when the first contamination separation device acts on clean water.

The open time is typically set approximately to the time required for emptying the settling compartment for water through the drain port, when the settling compartment has been filled up to the maximum filling level at the contaminant extraction port.

In a preferred embodiment, the adsorbing/absorbing material selectively adsorbs/absorbs oily contaminants, and not water. The adsorbing/absorbing material of the endless belt may be chosen to selectively take up oil rather than water, for example due to an increased affinity of the material for oil as compared to water, or due to physical interactions, such as capillarity and/or wettability, that are significantly different for oily contaminants and for water.

The endless belt material may be a felt material, a fibrous material, a spongy material, or a fur-like material and has to be resistant to the contaminants in the bilge water.

Further, in one embodiment according to the invention, the releasing means comprises at least one squeeze roller and/or at least one scraper subjecting the endless belt to a pressure sufficient to release adsorbed/absorbed contaminants. The released contaminant drips off the releasing means and in a downward direction into the collecting means, such as a drip pan, a gutter, or a hopper, and may be guided or pumped from the collecting means into a separate reservoir.

The term downward is in this application defined as the direction having a vector component pointing in the direction of the force of gravity. The term upward is in this application defined as the direction having a vector component pointing opposite to the direction of the force of gravity.

Further, in another embodiment according to the invention, the ship comprises a further contaminant separation device for processing the bilge water by separating contaminant from the bilge water, the further contaminant separation device being arranged to work in combination with the first contaminant separation device. The further contaminant separation device further processes the water cleaned by the conveyor arrangement. The further contaminant separation device may be arranged to work in combination with the conveyor arrangement by operating both devices in parallel to process the contaminated bilge water in the same sump, wherein the conveyor operates essentially continuously and at all contaminant concentration levels, and the further separation device only operates below a given threshold contaminant concentration level. Alternatively, the two devices may work in combination by operating sequentially, the conveyor arrangement thus firstly cleaning the bilge water to reduce the contaminant concentration level in the bilge water below a given threshold value and, after the contaminant concentration level has fallen below that threshold value, secondly processing the remaining bilge water with the further contaminant separation device. The bilge water is thus cleaned by the conveyor arrangement.

In practice, the further contaminant separation device is typically an oil/water separator (OWS), such as a gravity oil/water separator, a gravity oil/water separator with coalescing means, or the like.

In a further embodiment of the invention, the conveyor arrangement comprises a housing with a first side panel and a second side panel opposite to the first side panel, both side panels extending from the first portion at a first end of the housing to the second portion at a second end of the housing, a first guide roll extending from the first side panel to the second side panel at the first end, and a drive roll extending from the first side panel to the second side panel at the second end, wherein said drive roll is connected to a drive shaft of a drive motor via a drive gear, and is adapted to drive the endless belt to run around the drive roll and the first guide roll. The moving path of the endless belt comprises two straight sections extending substantially parallel to each other from the drive roll to the first guide roll. The housing may further comprise protection grids extending from the first side panel to the second side panel, the protection grids being arranged to protect the endless belt from larger items that may be present in the bilge water. Furthermore, a protection shield may be provided at the first end of the housing in order to protect the endless belt and the first guide roll from damage due to collision impact, for example when mounting and/or demounting the conveyor arrangement from its operation placement.

Typically, the bilge water sump in the engine room is covered by an arrangement of floor panels. In operation, it may be advantageous to provide an opening in the floor panels with fittings for mounting the conveyor arrangement with the first end of the housing pointing downward and being submerged into the bilge water sump.

In a further embodiment according to the invention, the releasing means is formed by at least one squeeze roller arranged to cooperate with the drive roll in order to release adsorbed/absorbed contaminants by pressing the endless belt against the drive roll, and/or to cooperate with at least one second guide roll in order to release adsorbed/absorbed contaminants by pressing the endless belt against the second guide roll, the second guide roll being arranged in the vicinity of the drive roll and being substantially parallel thereto within the moving path of the endless belt. The drive roll and the guide rolls can be provided inside the loop described by the endless belt, while the squeeze roller can be provided outside the loop described by the endless belt. The rotation axes of the squeeze roller, the drive roll, and the second guide roller are essentially parallel to each other. The diameter of the squeeze roller and the spacing between the drive roll and the second guide roll may be chosen so that the squeeze roller may cooperate with both the drive roll and the second guide roll to apply pressure to the endless belt for releasing adsorbed/absorbed contaminants. The pressure may be controlled by a pair of spring-loaded setscrews pulling the squeeze roller in a direction towards the housing and in between the drive roll and the second guide roll.

In a further embodiment according to the invention, the collecting means is formed by a hopper that is provided below the releasing means of the conveyor arrangement covering at least the full width of the endless belt. Thereby, the contaminants dripping from the releasing means are collected and the collected contaminants can be drained into a contaminant receptacle.

The materials chosen for the conveyor arrangement have to be able to withstand the harsh environment of the engine room of the ship. For example, the materials have to be able to withstand exposure to salt water, aggressive solvents and other chemicals, high temperatures, and humidity. Suitable material choices comprise, but are not limited to, brass, stainless steel, and Teflon.

In a further aspect of the invention, a bilge water cleaning system for separating contaminants from bilge water accumulating in a hull of a ship comprises a first contaminant separation device comprising a conveyor arrangement with an endless belt, the endless belt comprising adsorbing/absorbing material, said conveyor arrangement comprising a first portion submergible into the bilge water and contaminants in the bilge water sump, and a second portion being spaced from the first portion and being provided with releasing means for releasing adsorbed/absorbed contaminants from the endless belt and collecting means for collecting the contaminants released, wherein the conveyor arrangement is further provided with driving means for driving the endless belt along a moving path defined by guiding means, said system further comprising a gravitational separator device with a settling compartment having an input port, a contaminant extraction port being arranged in a top part of the settling compartment, and a drain port arranged in a bottom part of the settling compartment, wherein the input port is connected to the output port of the collecting means, the contaminant extraction port is connected to a contaminant receptacle, and the drain port is connected with the bilge water sump by means of a return line in which a drain valve is arranged.

As explained above, the first contamination separation device, being operated to clean the bilge water in the bilge water sump, produces contaminants and water at the collection means. The adsorbing/absorbing material of the endless belt is typically chosen so as to mostly adsorb/absorb contaminants rather than water. Preferably, the adsorbing/absorbing material selectively adsorbs/absorbs oily contaminants, and not water. However, even if the adsorbing/absorbing material of the endless belt selectively takes up oil, it is very difficult in practice to avoid a collateral production of water.

The contaminants and the water produced at the collecting means are therefore transferred to the settling compartment of the gravitational separation device at a sufficiently slow rate allowing for settling of the contaminant-water-mixture because of the difference in specific weight between the contaminants and the water, thereby providing a concentrated body of contaminants floating higher than the water. As the settling compartment becomes filled, the concentrated contaminants floating higher than the water may be extracted through the overflow extraction port arranged in the top part of the settling compartment. In order to avoid that the water gradually accumulating in the bottom part of the settling compartment spills over into the contaminant waste storage receptacle, the water is drained through the drain valve arranged at the bottom of the settling tank. Since the fluid body drained from the bottom still may contain contaminants mixed up with water, the drained fluid is returned to the bilge water sump, preferably close to where the first contaminant separation device is brought in contact with the bilge water, from where they again may be taken up and processed by the system. Contaminants are thus iteratively removed from the bilge water by repeatedly processing bilge water in the system according to the invention. The system produces concentrated contaminants that are stored in the contaminant receptacle. Eventually, the system produces water that may reach a level of cleanliness allowing for discharging the bilge water into the sea in agreement with corresponding legal regulations. Alternatively, the system may be operated to at least provide a level of cleanliness required so that a further, more sensitive separation device operates reliably in order to produce water that is suitable for discharge.

Advantageously by operating the system according to the invention on a ship the water content of the waste collected at the contaminant receptacle may be reduced from 50% to well below 5%, while at the same time the bilge water is cleaned to a level allowing for environmentally correct discharge of the water or at least to a level allowing for reliable operation of a further, more delicate, separation device producing clean water that then may be discharged into the sea in agreement with corresponding regulations.

In a further embodiment of a system according to the invention, the drain valve is by means of a valve actuator controllable in response to a signal, preferably an electrical signal, applied to the valve actuator.

Advantageously, the drain valve is adapted for automatic operation controlled by a signal provided from a control unit.

Further according to an embodiment of the invention, the signal applied to the valve actuator is a timer controlled signal.

Timer controlled opening and closing of the drain valve provides for automatic operation of the drain valve. Advantageously, the timer does not require any physical contact or optical access to the contaminant-water mixture. Therefore, the system according to the invention may operate more reliable than systems requiring delicate sensor arrangements for their operation. The timer control may be programmed as a timing sequence. The timing sequence may be stored in control unit.

In a further embodiment according to the invention, opening and closing of the drain valve is controlled by a predetermined timing sequence for alternately keeping the drain valve closed during a close time and open during an open time.

As mentioned previously, numerous timing sequence programs may be conceived. Surprisingly it has turned out in practice that a simple sequence with a fixed open time and a fixed close time works well for most situations occurring under routine operation. Therefore, both time settings may be determined with a simple calibration routine and programmed during an installation procedure. After the installation procedure, the open and close time settings do not require further attention during routine operation.

When choosing the values for the close time and the open time, priority is given to concentrating the contaminant waste in order to reduce the water content of the contaminant waste as much as possible, thereby reducing the amount of waste to be stored on the ship and the cost for eventually discharging the waste at an appropriate discharge facility.

In practice, the close time is typically set to the time required for filling the settling compartment with water up to the contaminant extraction port when the first contamination separation device acts on clean water.

The open time is typically set approximately to the time required for emptying the settling compartment for water through the drain port, when the settling compartment has been filled up to the maximum filling level at the contaminant extraction port.

In a further aspect, the invention relates to a method for removing contaminants from bilge water in a bilge water sump in a hull of a ship provided with a contaminant separation device comprising a conveyor arrangement with an endless belt comprising adsorbing/absorbing material, wherein the conveyor arrangement has a first portion and a second portion being spaced from the first portion, and wherein the conveyor arrangement is provided with driving means for driving the endless belt along a moving path defined by guiding means, said method comprising the steps of

- submerging the first portion of the conveyor arrangement into the bilge water sump to bring the endless belt into contact with the bilge water in the bilge water sump,
- moving the endless belt through the contaminated bilge water, thereby adsorbing/absorbing contaminants and removing the adsorbed/absorbed contaminants from the bilge water,
- releasing the adsorbed/absorbed contaminants from the endless belt by means of releasing means arranged in the second portion, and
- collecting the released contaminants in collecting means.

As mentioned above, the submerged part of the endless belt preferably takes up contaminants rather than water. The submerged portion of the endless belt is subsequently removed from the bilge water and transported to the releasing means of the conveyor arrangement by driving the endless belt along the moving path. Water taken up by the adsorbing/absorbing material drips off on the way from the bilge water to the releasing means. In practice, the water typically drips back into the bilge water sump. Water dripping off the endless belt may also be collected and lead away to a separate tank or to the intake of a further contaminant separation device for further cleaning of the water.

At the releasing means, the contaminants adsorbed/absorbed by the endless belt are released, for example by squeezing the endless belt between rolls and/or by scraping the contaminants off the belt using scraper blades, the released contaminants subsequently being collected by the collecting means.

Preferably, the uptake of contaminants by the endless belt is selective with respect to water in order to minimise the water content in the sludge of contaminants accumulated in the collecting means, thereby minimising the amount of hazardous waste to be stored on the ship and the cost for discharging the waste at a hazardous waste treatment facility in a harbour. If the processed bilge water is sufficiently clean to comply with relevant environmental regulations for discharge, the processed bilge water may be pumped out of the hull of the ship. Furthermore, in the case that the collected contaminants are intended for use in an incinerator on board of the ship, the water content of the collected contaminants has to be a minimum.

In a further embodiment, a method according to the invention comprises the steps of transferring the contaminants and, where appropriate, water collected in the collecting means from the collecting means to a settling compartment of a gravitational separator device, allowing the contaminants and the water to settle in the settling compartment so as to provide a fluid body with essentially contaminants in concentrated form in an upper region of the fluid body and essentially water in a bottom region of the fluid body, extracting concentrated contaminants from the upper region of the fluid body through a first extraction port of the settling compartment and transferring the concentrated contaminants to a contaminant receptacle, and draining the bottom region of the fluid body through a second extraction port of the settling compartment and returning said bottom region of the fluid body to the bilge water.

The total amount of contaminants and water produced at the collection means is transferred from the output port of the collecting means to the settling compartment of a gravitational separation device, preferably through a hose or pipeline. The transfer may be aided by pumping means, such as a hose pump. Thereby, the settling compartment is slowly filled with the mixture of contaminants and water. During the filling of the settling compartment, the mixture settles according to the differences in the specific weight, where the contaminants accumulate in a top part of the produced volume of the mixture and water accumulates in a bottom part.

The concentrated contaminants accumulating at the top are extracted from the settling compartment through the contamination extraction port, which is typically an overflow yielding into troughs and/or pipelines eventually leading the concentrated contaminants to a contaminant receptacle for storage and later discharge at a contaminant discharge facility.

In order to prevent the water accumulating at the bottom from reaching the contaminant extraction port, water may be drained through the drain valve arranged at the bottom of the settling compartment and returned to the bilge water sump through the return line.

The advantage of the method according to the invention is that the water content of the contaminant waste to be stored on the ship is reduced considerably, thereby reducing the total amount of contaminant waste collected on the ship, and thus cost for discharge of the contaminant waste in a harbour.

In a further embodiment of a method according to the invention, draining through the second extraction port is controlled by a drain valve, the drain valve being by means of a valve actuator controllable in response to a signal, preferably an electrical signal, applied to the valve actuator.

Advantageously, the drain valve is adapted for automatic operation controlled by a signal provided from a control unit.

In a further embodiment of a method according to the invention, the signal applied to the valve actuator is a timer controlled signal.

Timer controlled opening and closing of the drain valve provides for automatic operation of the drain valve. Advantageously, the timer does not require any physical contact or optical access to the contaminant-water mixture. Therefore, the system according to the invention may operate more reliable than systems requiring delicate sensor arrangements for their operation. The timer control may be programmed as a timing sequence. The timing sequence may be stored in control unit.

In a preferred embodiment of a method according to the invention, opening and closing of the drain valve is controlled by a predetermined timing sequence for alternately keeping the drain valve closed during a close time and open during an open time.

As mentioned previously, numerous timing sequence programs may be conceived. Surprisingly it has turned out in practice that a simple timing sequence with a fixed open time and a fixed close time works well for most situations encountered under routine operation. Therefore, both time settings may be determined with a simple calibration routine and programmed during an installation procedure. After the installation procedure, the open and close time settings do not require further attention during routine operation.

When choosing the values for the close time and the open time, priority is given to concentrating the contaminant waste in order to reduce the water content of the contaminant waste as much as possible, thereby reducing the amount of waste to be stored on the ship and the cost for eventually discharging the waste at an appropriate discharge facility.

In practice, the close time is typically set to the time required for filling the settling compartment with water up to the contaminant extraction port when the first contamination separation device acts on clean water.

The open time is typically set approximately to the time required for emptying the settling compartment for water through the drain port, when the settling compartment has been filled up with water to the maximum filling level at the contaminant extraction port.

In a further embodiment, the method according to the invention further comprises continuous monitoring of the contaminant concentration and continuous driving of the endless belt in order to reach and/or maintain a predetermined contaminant concentration level. Monitoring the contaminant concentration can be performed using a known sensor arrangement, for example by measuring the optical properties of the bilge water.

The predetermined level of contaminants may be a level acceptable for substantially reducing or eliminating the fire hazard in the machinery space, due to contaminants in the bilge water.

The predetermined level of contaminants may be also be a level at which the amount of unhealthy vapours in the air of the engine room is reduced so much that they do not constitute a substantial health hazard anymore.

The predetermined level of contaminants may also be a level allowing for a discharge of the cleaned bilge water into the sea without violating relevant environmental regulations.

In a further embodiment of the invention, the bilge water having reached the predetermined contaminant concentration level is processed by means of a further contaminant separator device. In practice, to achieve an acceptable contaminant concentration level, for example for discharge of the cleaned bilge water into the sea, may require processing the bilge water cleaned by the conveyor arrangement in a further separation stage by means of a further contaminant separator device. The further contaminant separator device may be of a known type. The conveyor belt arrangement preconditions the bilge water to a contaminant concentration level acceptable by the further contaminant separator device, thereby ensuring a stable and reliable operation of the further contaminant separator device.

In a further embodiment of the method according to the invention, the bilge water is processed in the further contaminant separation device until a contaminant concentration level has been reached allowing the bilge water to be discharged into the sea. The actual contaminant concentration level for allowing the bilge water to be discharged into the sea depends on local environmental regulations regarding the pollution from ships, typically with basis in international conventions, such as the above mentioned MARPOL 73/76 convention. The bilge water treatment method according to the invention may be applied to treat the bilge water until such a locally determined contaminant concentration level is achieved. Operation of the conveyor arrangement provides for a pre-conditioning of the bilge water to cope with large amounts of contaminants, in periods of peak load and/or in the case of an accident or excessive oil spill in the machinery space, e.g. in connection with maintenance or repair work in the machinery space. The further oil/water separator device, comprising sophisticated and more delicate equipment, may be operated in combination with the conveyor arrangement for achieving the very low concentration levels required to allow for discharge of the bilge water into the sea.

BRIEF DESCRIPTION OF THE DRAWING(S)

In the following, the invention is explained in detail by an exemplifying embodiment with reference to the drawings. The drawings show in FIG. 1 schematically, a ship according to the invention comprising a first contaminant separation device comprising a conveyor arrangement, FIG. 2 schematically, an enlarged cross-sectional view of the conveyor arrangement of FIG. 1, FIG. 3*a*-FIG. 3*d* examples of different shapes of moving paths of the endless belt, FIG. 4 a flowchart for a method for cleaning bilge water according to the invention, and FIG. 5 schematically, a system according to the invention comprising a first contaminant separation device, a gravitational separation device, a drain valve, and a control unit.

DETAILED DESCRIPTION OF THE INVENTION

Figure 2:
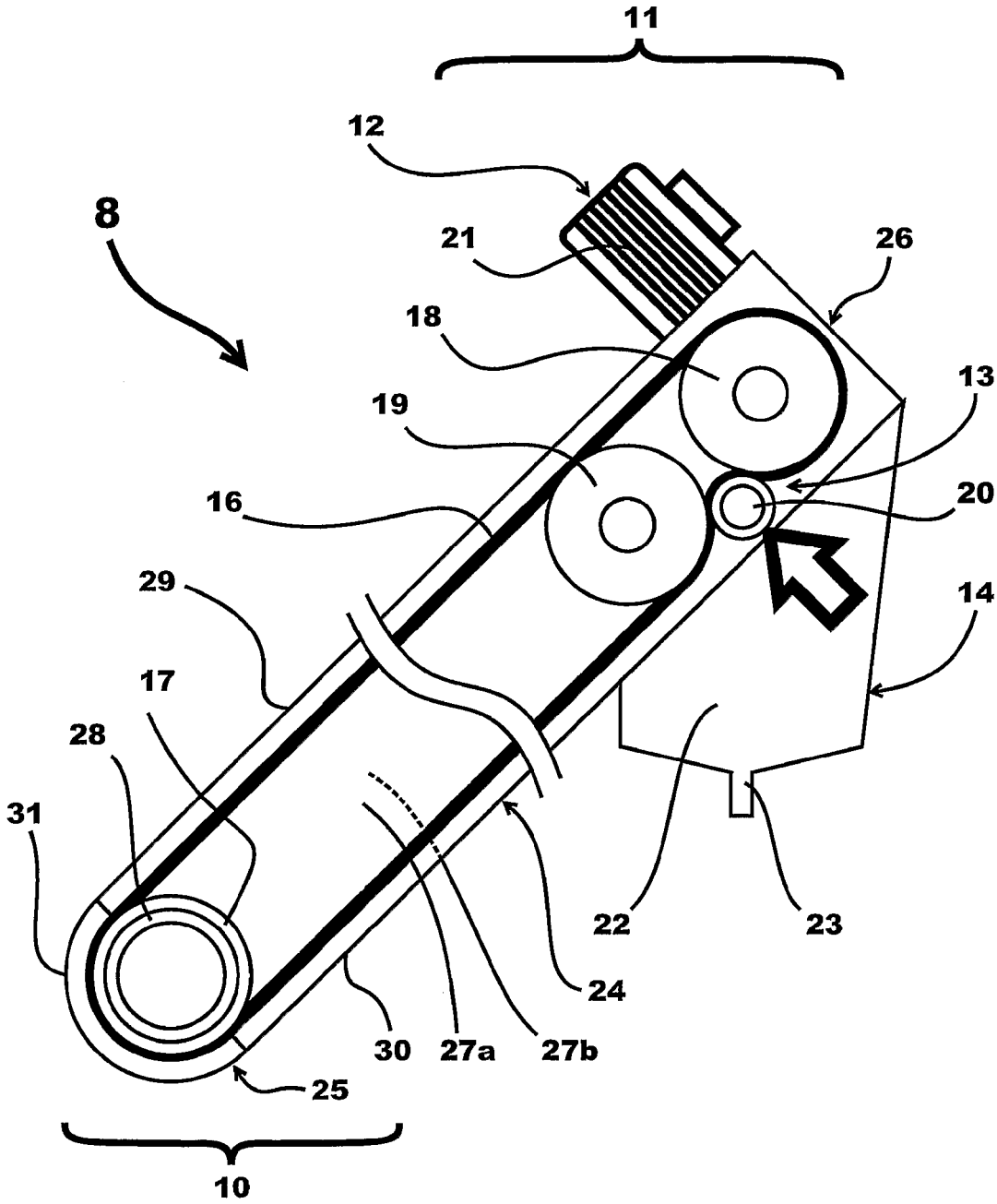

FIG. 1 schematically shows a ship 1 with a hull 2 comprising a engine room 3 accommodating machinery, such as the engine 4. The engine room 3 is provided with a bilge water sump 5 collecting bilge water 6 and contaminants. The bilge water sump 5 may be covered by an arrangement of floor panels 7. A first contaminant separation device with a conveyor arrangement 8 comprising an endless belt 16 extends through an opening in the floor panels 7 into the bilge water sump 5 and below the surface 9 of the bilge water 6. A first portion 10 of the conveyor arrangement 8 is thereby at least partially submerged in the bilge water 6. A second portion 11 of the conveyor arrangement 8 comprising driving means 12, releasing means 13, and collecting means 14 is arranged above the floor panels 7. The collecting means 14 may be connected to a waste reservoir 15 for receiving the collected contaminants.

The conveyor arrangement 8 may be mounted in a frame fixed to the floor panel arrangement 7 and secured in place with fixation means (not shown). This has the advantage that the conveyor arrangement 8 or parts of the conveyor arrangement 8 can easily be accessed from above the floor panels 7 and retracted from the bilge water sump 5, thereby facilitating maintenance work to be performed on the conveyor arrangement 8, such as changing the endless belt 16.

When the ship is at rest or moving steadily, the oily contaminant compounds and the water tend to separate. Gravitational separation may occur, i.e. the contaminant compounds lighter than water may accumulate at the surface 9 of the bilge water 6 and the contaminants heavier than water may sink to the bottom. However, when sailing at sea, the rolling movements of the ship 1 in the waves will agitate the bilge water 6, thereby counteracting or even impeding the above mentioned gravitational separation process. The advantage of the conveyor arrangement 8 is that it works even though the contaminants are well mixed with the water. Furthermore, practical experience has shown that the conveyor arrangement works at substantially all contaminant concentration levels commonly observed on ships.

FIG. 2 shows a cross-sectional view of the conveyor arrangement 8 for use in a ship 1 according to the invention. The endless belt 16 is guided by a first guide roll 17 provided in the first portion 10 of the conveyor arrangement 8 and a drive roll 18 provided in the second portion 11 of the conveyor arrangement 8. A second guide roll 19 may be provided in the second portion of the conveyor arrangement 8.

The driving means 12 may drive the endless belt 16 to run along the moving path defined by the rolls 17, 18, 19. The driving means comprise a motor 21 with a drive axle that via a gear is connected to the drive roll 18. The drive roll 18 may be coated with oil-resistant rubber in order to provide sufficient friction for driving the endless belt 16.

In operation, the first portion 10 of the conveyor arrangement 8 is, as mentioned, at least partially submerged into the bilge water 6 so as to bring a section of the endless belt 16 in contact with the bilge water 5 and the contaminants therein. The submerged section of the endless belt 16 preferably takes up contaminants rather than water. By driving the endless belt 16 to move along the moving path, the submerged section of the endless belt 16 is moved out of the bilge water and transferred to the second portion 11 of the conveyor arrangement 8 provided with releasing means 14 for releasing the adsorbed/absorbed contaminants from the endless belt 16.

The releasing means 14 comprise a squeeze roller 20 cooperating with the second guide roll 19 and/or the drive roll 18 to apply a pressure on the endless belt 16 sufficient for releasing the adsorbed/absorbed contaminants. To apply that pressure, the squeeze roller may be pressed/pulled against the endless belt in the direction of the rolls 18, 19 as indicated by the arrow in FIG. 2—for example by means of a spring (not shown) the biasing of which can be regulated by means of a screw connection, thereby adjusting the pressure on the endless belt 16 for releasing the contaminants adsorbed/absorbed by the endless belt 16. Furthermore, the squeeze roller 20 may act as an adjustable tension roll for tensioning the endless belt 16.

The collecting means 14 is provided below the releasing means 13 for collecting the released contaminants dripping off the squeeze roller 20 and the endless belt 16 compressed by the squeeze roller and the cooperating guide roll 19 and/or drive roll 18. The collecting means 14 may comprise a hopper 22 provided with a spout 23 at the bottom for connecting the hopper 22 with a contaminant waste storage receptacle 15 for storing the accumulated sludge of collected contaminants for appropriate discharge, for example in a hazardous waste treatment facility in a harbour at a later time.

The conveyor arrangement 8 advantageously comprises a protective housing 24. A first side pane 27*a* and a second side pane 27*b* opposite to the first side pane 27*a* extend from a first end 25 to a second end 26 of the housing 24. At the first end 25, the side panes 27*a*, 27*b* support the first guide roll 17, preferably by means of an axle 28. At the second end, the side panes 27*a*, 27*b* support the drive roll 18 and the second guide roll 19 and may further support the driving means 12, the releasing means 13, and the collecting means 14.

In a preferred embodiment, an upper protection grid 29 is provided on the upward facing side of the housing 24 and a lower protection grid 30 is provided on the downward facing side of the housing 24. The protection grids 29, 30 substantially extend in a transverse direction from the first side panel 27*a* to the second side panel 27*b*, and in a longitudinal direction substantially from the first end 25 of the housing 24 to the area adjacent to the second portion 11 of the conveyor arrangement 8 at the second end 26 of the housing 24.

The protection grids 29, 30 protect the moving parts of the conveyor arrangement 8 from damage, for example due to loose objects in the bilge water sump 5 colliding with or mingling into the moving parts of the conveyor arrangement 8 during operation. Furthermore, advantageously a protection shield 31 is provided at the first end 25 of the housing 24 for protecting the first portion of the conveyor arrangement 10 from collision impact, for example when mounting and demounting the conveyor arrangement 8 for maintenance and/or inspection.

Further, advantageously the guide rolls 17, 19 and the drive roll 18 may be provided with circumferential guiding means for restraining the movements of the endless belt in a direction parallel to the rotation axes of the rolls 17, 18, 19, i.e. transverse to the moving path of the endless belt 16, thereby ensuring that the endless belt stays on the guide rolls 17, 19 and the drive roll 18.

The circumferential guiding means may be provided as radial projections on both ends of the roll 17, 18, 19, or as a guide pulley fixed to the roll 17, 18, 19. Alternative, the roll 17, 18, 19 may have an outer diameter that decreases from the ends of the roll inward towards the middle of the roll, thereby providing two conical sections pointing towards each other and forming a constriction in the middle of the roll. Thereby, a tendency of the endless belt to deviate from its moving path in a transverse direction is counteracted by forces provided by the conical sections and pointing towards the constriction in the middle of the roll.

FIGS. 3*a*-3*d* show examples of the shape of the moving path in alternative embodiments of a conveyor arrangement for use in a ship according to the invention.

Figure 3A:
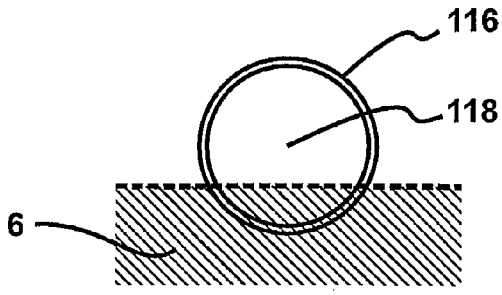

FIG. 3*a* shows an embodiment with a circular moving path, wherein the endless belt 116 is arranged on the peripheral surface of the drive roll 118 and partially submerged in the bilge water 6.

Figure 3B:
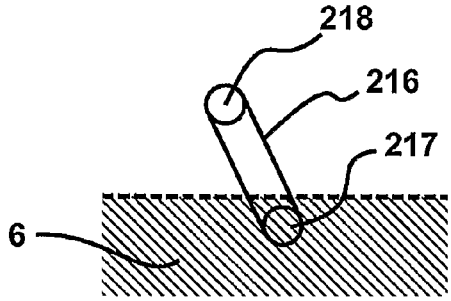

FIG. 3*b* shows an embodiment with an elongated moving path corresponding to the conveyor arrangement shown in FIG. 2 with an endless belt 216 running around the first guide roll 217 and driven by the drive roll 218. The endless belt is partially submerged in the bilge water 6.

Figure 3C:
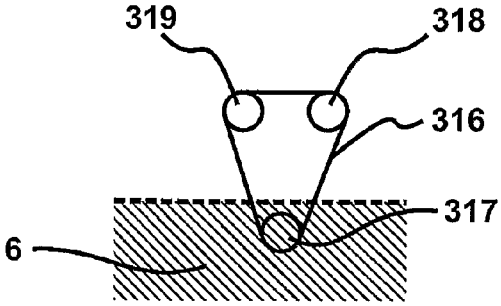

FIG. 3*c* shows an embodiment with a substantially triangular moving path, wherein the endless belt 316 runs around a first guide roll 317, a second guide roll 319 and a drive roll 318 and is partially submerged in the bilge water 6.

Figure 3D:
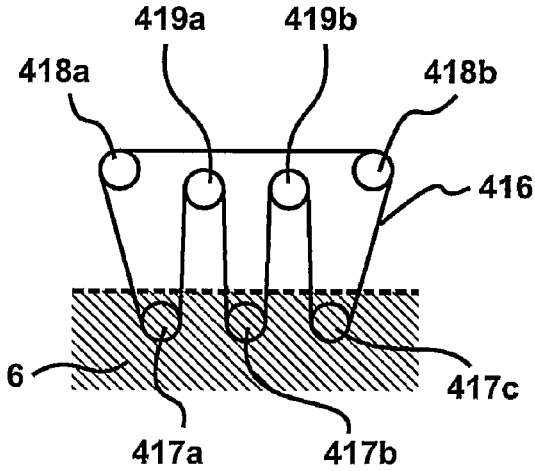

FIG. 3*d* shows an embodiment with a folded moving path, wherein sections of the endless belt 416 are repeatedly submerged into and removed from the bilge water 6 guided by a plurality of first guide rolls 417*a*, 417*b*, 417*c* and one or more second guide rolls 419*a*, 419*b*, and driven by one or more drive rolls 418*a*, 418*b*. Advantageously, in this embodiment, a plurality of releasing means and collecting means may be provided, for example in the vicinity of the second guide rolls 419*a*, 419*b* for releasing adsorbed/absorbed contaminants from the endless belt 416 and subsequently collecting the released contaminants each time the endless belt 416 is guided out of the bilge water 6.

Figure 4:
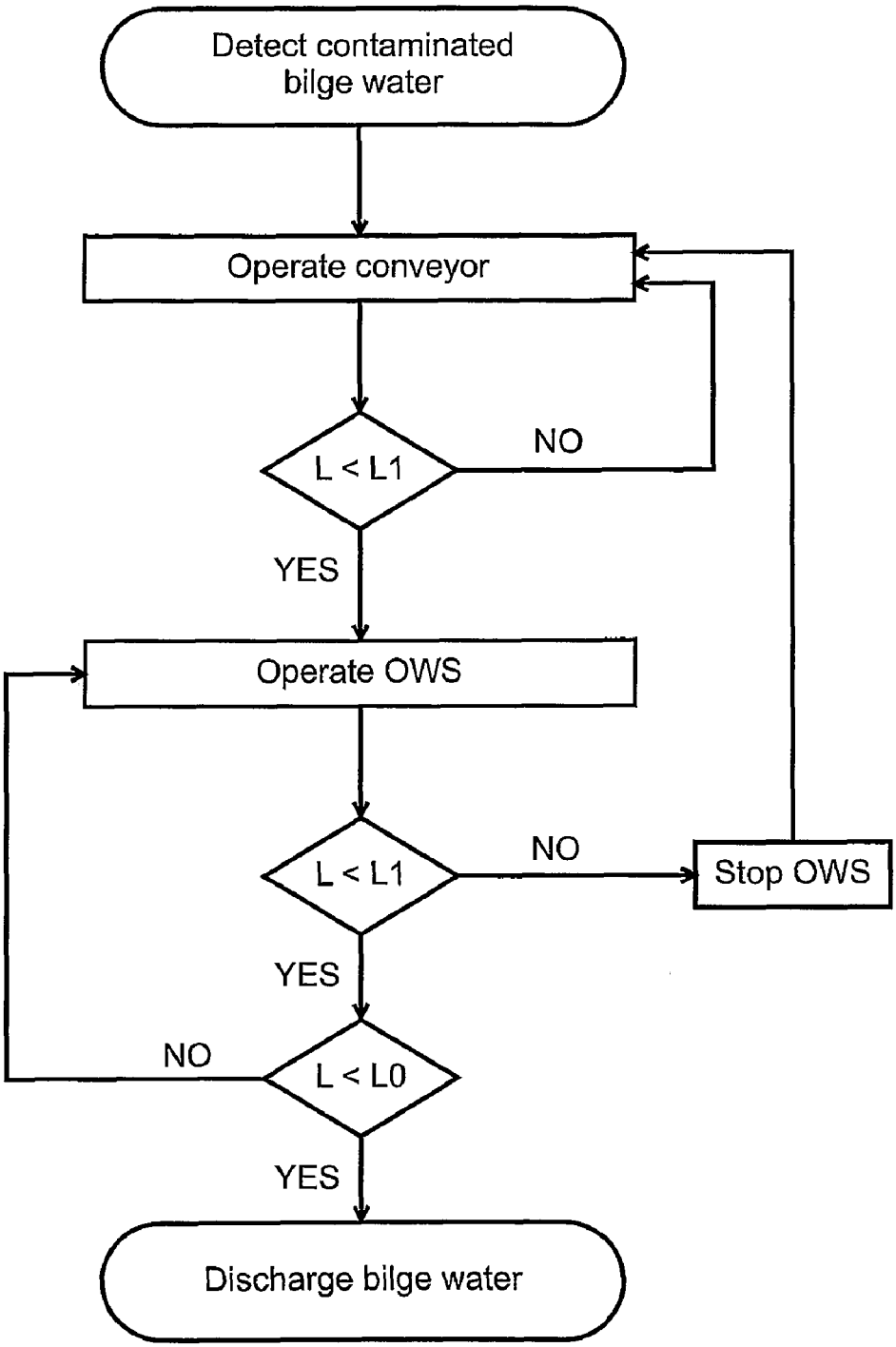
Figure 5:
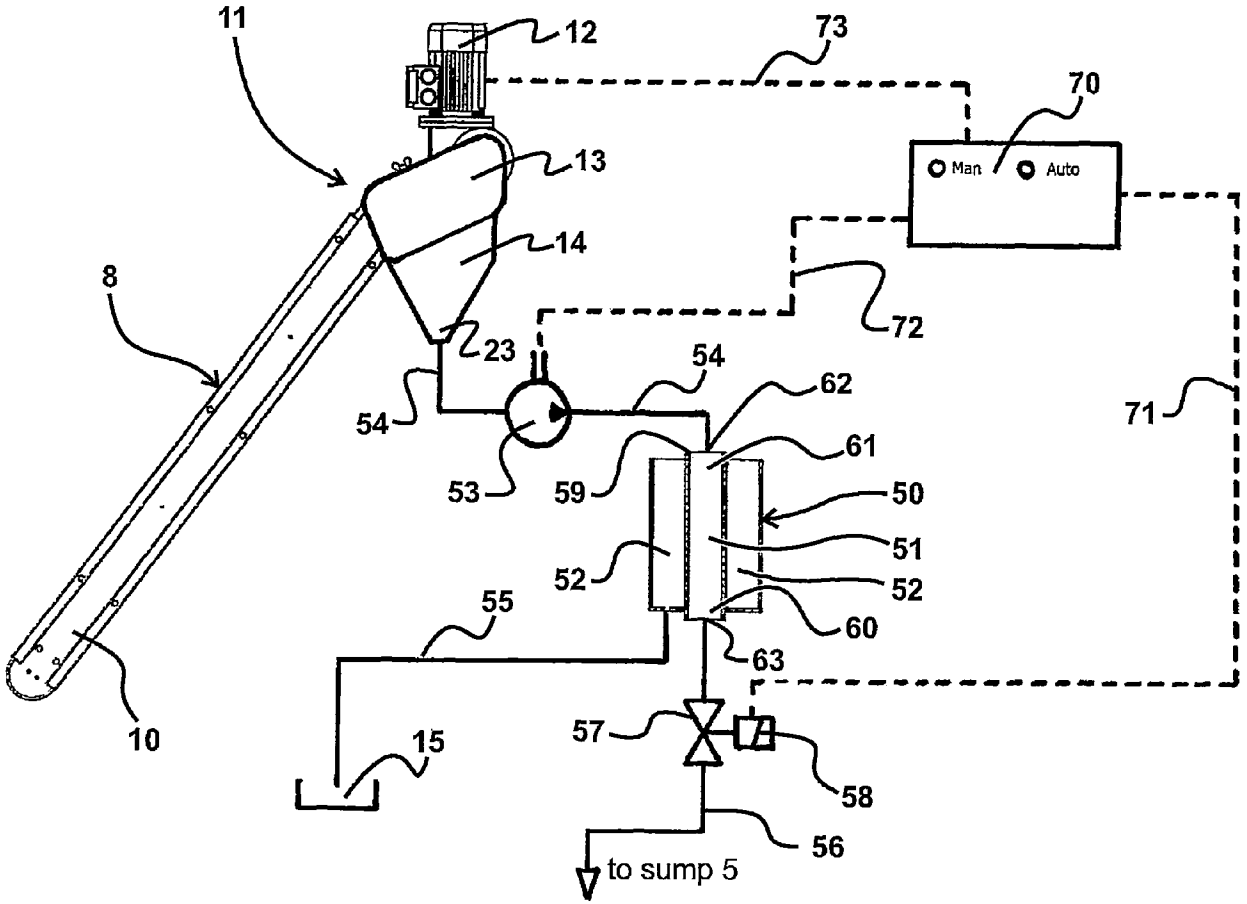

FIG. 4 shows a flow chart of an embodiment of a method for cleaning bilge water 6 according to the invention. When contaminated bilge water 6 is detected in the bilge water sump 5 of a ship 1, the conveyor arrangement 8 is operated and the contaminant concentration level L in the bilge water 6 is monitored using a known sensor arrangement. When the contaminant concentration level L descends below an upper threshold level L1, a further contaminant separation device (not shown), such as a known oil/water separator OWS, is operated to process the bilge water 6 cleaned by the conveyor arrangement 8. The contaminant concentration level L in the bilge water 6 is monitored. If the contaminant concentration level L increases to L1 or above, operation of the oil/water separator OWS is stopped, and only the conveyor arrangement 8 is operated to process the bilge water. Operation of the oil/water separator OWS is resumed when the contaminant concentration level L decreases below the upper threshold L1. When the contaminant concentration level L of contaminants in the bilge water 6 further decreases below a lower threshold L0, the bilge water 6 may be considered sufficiently clean to be discharged, and the cleaned bilge water 6 may be pumped out of the hull 2 of the ship 1.

FIG. 5 shows schematically, a system according to the invention. The system comprises a first contaminant separation device with a conveyor arrangement 8 having a first portion 10 and a second portion 11. The conveyor arrangement 8 may be operated as explained above by submersing the first portion 10 into the bilge water in the bilge water sump in order take up contaminants from the bilge water and produce the contaminants at the collecting means 14 at the second portion 11. Typically, a mixture of contaminants and collaterally produced water is collected at the collecting means 14, because water is dragged up by the endless belt of the conveyor arrangement 8 and may reach the second portion 11 where it may drip off into the collecting means 14.

The system further comprises a gravitational separation device 50 with a settling compartment 51 and an overflow recipient 52. A pump 53, such as a peristaltic pump, and a pipeline 54 connecting the spout 23 of the collecting means 14 with an input port 62 of the settling compartment 51 are provided for transferring the contaminant-water mixture from the collecting means 14 to the settling compartment 51.

The contaminant-water mixture is transferred approximately at the same rate as it is produced at the collection means 14. The volume of the settling compartment 51 is chosen to provide a sufficient dwell time for the mixture to settle in the settling compartment, thereby allowing the mixture to separate into a body of concentrated contaminants floating on top of a body of water accumulating at the bottom part 60 of the settling compartment 51.

In practice, a settling compartment 51 with a volume to allow for a settling time of about an hour has been found to work adequately. More specifically, for a first contaminant separation device with a maximum contaminant production capacity of 3 liters per hour and a maximum water production rate when acting on clean water of about 1.5 liters per hour, a settling compartment volume of about 1.5 liters was found to work well.

At the top part 61 of the settling compartment 51*a* contaminant extraction port 59 is provided, here shown as a simple overflow edge yielding into an overflow recipient 52 for collecting the concentrated contaminants. The overflow recipient 52 is via a pipeline 55 connected to a contaminant waste receptacle 15 where the concentrated contaminants are stored until discharge at an appropriate discharge facility.

At the bottom part 60 of the settling compartment 51, a drain port 63 with a drain valve 57 is provided for draining the settling compartment 51 in order to prevent accumulated water from spilling over into the overflow recipient 52 and eventually from spilling over into the contaminant waste storage receptacle 15. The fluid released through the drain valve 57 is returned to the bilge water sump, where it again may be taken up by the system for repeating the separation process, thereby iteratively reducing the level of contamination of the bilge water until the bilge water becomes clean enough for discharge into the sea in compliance with the corresponding legal regulations and/or for allowing for stable operation of more delicate oily water separation systems (OWS).

The drain valve 57 is provided with a magnetic valve actuator 58 controlled according to a timer signal provided from a control unit 70. The control unit 70 may further provide signals for the control the electromotor of the driving means 12 of the conveyor arrangement 8 and the pump 53 through electrical lines 73 and 72, respectively.

The control unit 70 may have two operational states, namely a manual state and an automatic state. In the manual state, the driving means 12 and the pump 53 may be switched on and off manually, and the drain valve is opened and closed manually. In the automatic state, the driving means 12 and the pump 53 run continuously, and the drain valve 57 is alternately kept closed during a close time t1 and open during an open time t2.

The close time may be determined during installation by operating the system on clean water and measuring the time for the system to accumulate water to fill the settling compartment up to the contaminant extraction port 59. In the present embodiment and for the above mentioned dimensions of the settling compartment having a volume of 1.5 liters, the thus determined close time is about 55 min.

The open time may be determined by filling the settling compartment with water up to the contaminant extraction port, opening the drain valve and measuring the time it takes to empty the settling compartment for water. In the present embodiment, an open time of about 1 min was found adequate.

The invention has been described with reference to preferred embodiments. However, the scope of the invention is not limited to the illustrated embodiments, and alterations and modifications can be carried out without deviating from the scope of the invention. For example, the substantially straight moving path of the endless belt may have one or more bends in order to adapt the conveyor arrangement to different spatial requirements in the engine room, to different releasing means, and/or to different collecting means. Furthermore, the bilge water sump may comprise at least one dedicated bilge water tank for receiving bilge water which is collected elsewhere inside the hull of the ship and transferred to the bilge water tank by means of pumping devices.

LIST OF REFERENCE NUMERALS

1 ship
2 hull
3 engine room
4 engine
5 bilge water sump
6 bilge water
7 floor panel
8 conveyor arrangement
9 bilge water surface
10 first portion
11 second portion
12 driving means
13 releasing means
14 collecting means
15 waste reservoir
16 endless belt
17 first guide roll
18 drive roll
19 second guide roll
20 squeeze roller
21 drive motor
22 hopper
23 spout
24 housing
25 first end
26 second end
27*a* first side panel
27*b* second side panel
28 bushing
29 protection grid
30 protection grid
31 protection shield
50 gravitational separation device
51 settling compartment
52 overflow recipient
53 pump
54, 55 pipeline
56 return line
57 drain valve
58 valve actuator
59 contaminant extraction port
60 bottom part
61 top part
62 input port
63 drain port
70 control unit
71, 72, 73 electrical line
116, 216, 316, 416 endless belt
117, 217, 317, 417*a*, 417*b*, 417*c* first guide roll
118, 218, 318, 418*a*, 418*b* drive roll
119, 219, 319, 419*a*, 419*b* second guide roll
OWS Oil/water separator
L Contaminant concentration level
L1 OWS contaminant concentration level threshold
L0 Discharge contaminant concentration level threshold
t1 Close time
t2 Open time

The invention claimed is:

1. A ship (1) comprising a bilge water sump (5) for collecting bilge water (6) and contaminants, said bilge water sump (5) optionally being covered by one or more floor panels (7), characterised in that the ship further comprises a first contaminant separation device comprising a conveyor arrangement (8) with an endless belt (16), the endless belt (16) comprising adsorbing/absorbing material, said conveyor arrangement (8) comprising a first portion (10) submergible into the bilge water and contaminants in the bilge water sump (5), and a second portion (11) being spaced from the first portion (10) and being provided with releasing means (13) for releasing adsorbed/absorbed contaminants from the endless belt (16) and collecting means (14) for collecting the contaminants released, wherein the conveyor arrangement (8) is further provided with driving means (12) for driving the endless belt (16) along a moving path defined by guiding means, a gravitational separator device (50) with a settling compartment (51) having an input port (62), a contaminant extraction port (59) being arranged in a top part (61) of the settling compartment (51), and a drain port (63) arranged in a bottom part (60) of the settling compartment (51), wherein the input port (62) is connected to the output port (23) of the collecting means (14), the contaminant extraction port (59) is connected to a contaminant receptacle (15), and the drain port (63) is connected with the bilge water sump (5) by means of a return line (56).

2. Ship according to claim 1, wherein a drain valve (57) is arranged in the return line (56).

3. Ship according to claim 1, wherein the adsorbing/absorbing material mostly adsorbs/absorbs contaminants rather than water.

4. Ship according to claim 3, wherein the drain valve (57) is by means of a valve actuator (58) controllable in response to a signal, preferably an electrical signal, applied to the valve actuator (58).

5. Ship according to claim 4, wherein the signal applied to the valve actuator (58) is a timer controlled signal.

6. Ship according to claim 5, wherein opening and closing of the drain valve (57) is controlled by a predetermined timing sequence for alternately keeping the drain valve (57) closed during a close time (t1) and open during an open time (t2).

7. Ship according to claim 1, wherein the adsorbing/absorbing material selectively adsorbs/absorbs oily contaminants, and not water.

8. Ship according to claim 1, wherein the releasing means (13) comprises squeeze rollers (20) and/or scrapers subjecting the endless belt (16) to a pressure sufficient to release adsorbed/absorbed contaminant.

9. Ship according to claim 1, wherein the ship (1) comprises a further contaminant separation device for processing the bilge water by separating contaminant from the bilge water, the further contaminant separation device being arranged to work in combination with the conveyor arrangement (8).

10. Ship according to claim 1, wherein the conveyor arrangement (8) comprises a housing (24) with a first side panel (27*a*) and a second side panel (27*b*) opposite to the first side panel (27*a*), both side panels (27*a*, 27*b*) extending from the first portion (10) at a first end (25) of the housing (24) to the second portion (11) at a second end (26) of the housing (24), and a first guide roll (17) extending from the first side panel (27*a*) to the second side panel (27*b*) at the first end (25), and a drive roll (18) extending from the first side panel (27*a*) to the second side panel (27*b*) at the second end (26), wherein said drive roll (18) is connected to a drive shaft of a drive motor (21), and is adapted to drive the endless belt (16) to run around the drive roll (18) and the first guide roll (17).

11. Ship according to claim 9, wherein the releasing means is formed by at least one squeeze roller (20) arranged to cooperate with the drive roll (18) in order to release adsorbed/absorbed contaminants by pressing the endless belt (16) against the drive roll (18), and/or cooperate with at least one second guide roll (19) in order to release adsorbed/absorbed contaminants by pressing the endless belt (16) against the second guide roll (19), the second guide roll (19) being arranged in the vicinity of the drive roll (18) and being parallel thereto within the moving path of the endless belt (16).

12. Ship according to claim 1, wherein the collecting means is formed by a hopper (22) that is provided below the releasing means (13) of the conveyor arrangement (8) covering at least the full width of the endless belt (16) so as to collect the contaminants dripping from the releasing means (13) and drain the contaminants into a contaminant receptacle.

13. Bilge water cleaning system for removing contaminants from bilge water in a bilge water sump (5) in a hull (2) of a ship (1), said system comprising a first contaminant separation device comprising a conveyor arrangement (8) with an endless belt (16), the endless belt (16) comprising adsorbing/absorbing material, said conveyor arrangement (8) comprising a first portion (10) submergible into the bilge water and contaminants in the bilge water sump (5), and a second portion (11) being spaced from the first portion (10) and being provided with releasing means (13) for releasing adsorbed/absorbed contaminants from the endless belt (16) and collecting means (14) for collecting the contaminants released, wherein the conveyor arrangement (8) is further provided with driving means (12) for driving the endless belt (16) along a moving path defined by guiding means, said system further comprising a gravitational separator device (50) with a settling compartment (51) having an input port (62), a contaminant extraction port (59) being arranged in a top part (61) of the settling compartment (51), and a drain port (63) arranged in a bottom part (60) of the settling compartment (51), wherein the input port (62) is connected to the output port (23) of the collecting means (14), the contaminant extraction port (59) is connected to a contaminant receptacle (15), and the drain port (63) is connected with the bilge water sump (5) by means of a return line (56).

14. Bilge water cleaning system according to claim 13, wherein a drain valve (57) is arranged in the return line (56).

15. Bilge water cleaning system according to claim 13, wherein the drain valve (57) is by means of a valve actuator (58) controllable in response to a signal, preferably an electrical signal, applied to the valve actuator (58).

16. Bilge water cleaning system according to claim 15, wherein the signal applied to the valve actuator (58) is a timer controlled signal.

17. Bilge water cleaning system according to claim 16, wherein opening and closing of the drain valve (57) is controlled by a predetermined timing sequence for alternately keeping the drain valve (57) closed during a close time (t1) and open during an open time (t2).

18. Method for removing one or more contaminants from bilge water in a bilge water sump (5) in a hull (2) of a ship (1) provided with a contaminant separation device comprising a conveyor arrangement (8) with an endless belt (16) comprising adsorbing/absorbing material, wherein the conveyor arrangement (8) has a first portion (10) and a second portion (11) being spaced from the first portion (10), and wherein the conveyor arrangement (8) is provided with driving means (12) for driving the endless belt (16) along a moving path defined by guiding means, said method comprising the steps of submerging the first portion of the conveyor arrangement (8) into the bilge water sump (5) to bring the endless belt (16) into contact with the bilge water in the bilge water sump (5), moving the endless belt (16) through the contaminated bilge water, thereby adsorbing/absorbing contaminants, releasing the adsorbed/absorbed contaminants from the endless belt (16) by means of releasing means (13) arranged in the second portion (11), and collecting the released contaminants in collecting means (14)

transferring the contaminants and, where appropriate, water collected in the collecting means (14) from the collecting means (14) to a settling compartment (51) of a gravitational separator device (50), allowing the contaminants and the water to settle in the settling compartment (51) so as to provide a fluid body with essentially contaminants in concentrated form in an upper region of the fluid body and essentially water in a bottom region of the fluid body, extracting concentrated contaminants from the upper region of the fluid body through a first extraction port (59) of the settling compartment (51) and transferring the concentrated contaminants to a contaminant receptacle (15), and draining the bottom region of the fluid body through a second extraction port (63) of the settling compartment (51) and returning said bottom region of the fluid body to the bilge water.

19. Method according to claim 18, wherein draining through the second extraction port (63) is controlled by a drain valve (57).

20. Method according to claim 19, the drain valve (57) being by means of a valve actuator (58) controllable in response to a signal, preferably an electrical signal, applied to the valve actuator (58).

21. Method according to claim 19, wherein the signal applied to the valve actuator (58) is a timer controlled signal.

22. Method according to claim 21, wherein opening and closing of the drain valve (57) is controlled by a predetermined timing sequence for alternately keeping the drain valve (57) closed during a close time (t1) and open during an open time (t2).

23. Method according to claim 18, further comprising continuous monitoring of the contaminant concentration and continuous driving of the endless belt (16) in order to reach and/or maintain a predetermined contaminant concentration level.

24. Method according to claim 23, wherein the bilge water having reached the predetermined contaminant concentration level is processed by means of a further contaminant separator device.

25. Method according to claim 24, wherein the bilge water is processed in the further contaminant separation device until a contaminant concentration level has been reached allowing the bilge water to be discharged into the sea.

* * * * *